US007841586B1

(12) United States Patent
Mongeon et al.

(10) Patent No.: US 7,841,586 B1
(45) Date of Patent: Nov. 30, 2010

(54) HUMIDIFICATION APPARATUS AND METHOD OF MANUFACTURE AND USE

(75) Inventors: Douglas R. Mongeon, Orange, CA (US); Jeffrey T. Ruch, Newport Beach, CA (US)

(73) Assignee: Humid-EZE, Inc., Buena Park, CA (US)

( * ) Notice: Subject to any disclaimer, the term of this patent is extended or adjusted under 35 U.S.C. 154(b) by 1012 days.

(21) Appl. No.: 11/644,301

(22) Filed: Dec. 22, 2006

Related U.S. Application Data

(60) Provisional application No. 60/753,700, filed on Dec. 23, 2005.

(51) Int. Cl.
*B01F 3/04* (2006.01)

(52) U.S. Cl. ..... 261/104; 156/250; 156/289

(58) Field of Classification Search ..... 261/97, 261/99, 104, 107, DIG. 34; 156/90, 250, 156/289

See application file for complete search history.

(56) References Cited

U.S. PATENT DOCUMENTS

| | | | | |
|---|---|---|---|---|
| 1,474,254 | A | 11/1923 | Gerstle | |
| 1,481,325 | A | 1/1924 | Gris | |
| 1,700,574 | A | 1/1929 | Smith | |
| 1,871,419 | A * | 8/1932 | McKee | 239/34 |
| 2,623,781 | A | 12/1952 | Hagan | |
| 3,323,784 | A | 6/1967 | Fazio | |
| 4,157,787 | A * | 6/1979 | Schwartz | 239/56 |
| 4,634,614 | A * | 1/1987 | Holzner | 428/34.2 |
| 4,753,389 | A * | 6/1988 | Davis | 239/6 |
| 5,037,459 | A | 8/1991 | Spruill | |
| 5,230,867 | A | 7/1993 | Kunze | |
| 5,518,790 | A * | 5/1996 | Huber et al. | 428/35.2 |
| 5,575,992 | A * | 11/1996 | Kunze | 424/76.4 |
| D394,522 | S | 5/1998 | Putnam | |
| 5,829,452 | A | 11/1998 | Oster | |
| D406,388 | S | 3/1999 | Putnam | |
| D408,099 | S | 4/1999 | Putnam | |
| D409,330 | S | 5/1999 | Putnam | |
| 5,901,710 | A * | 5/1999 | Barber | 131/274 |
| 5,934,773 | A | 8/1999 | Ferrell | |
| 6,279,581 | B1 | 8/2001 | Knepper | |
| 6,551,560 | B1 * | 4/2003 | Flashinski et al. | 422/125 |
| 6,755,396 | B1 * | 6/2004 | Weinrich | 261/30 |
| 7,070,172 | B2 * | 7/2006 | Fabrega et al. | 261/30 |
| 7,344,123 | B2 * | 3/2008 | Pankhurst et al. | 261/30 |
| 2003/0067086 | A1 | 4/2003 | Mulvaney | |

* cited by examiner

*Primary Examiner*—Scott Bushey
(74) *Attorney, Agent, or Firm*—Mind Law Firm; Justin G. Sanders; Jeromye V. Sartain

(57) ABSTRACT

A humidification apparatus comprising a reservoir having at least one side wall defining an opening, water within the reservoir bounded by the at least one side, and a membrane activation assembly installed over the opening. The membrane activation assembly comprises a microporous membrane layer covering the opening of the reservoir and a temporary peel-away activation layer covering the membrane layer. A method of using the humidification apparatus comprises the steps of grasping a pull-tab formed on the activation layer, peeling the activation layer away from the underlying membrane layer, and inserting within an enclosed space the reservoir containing water bounded at its opening by the activated membrane layer. A method of manufacturing the humidification apparatus comprises numerous laminating and die-cutting steps to form a completed membrane activation assembly that is then installed on the reservoir.

13 Claims, 5 Drawing Sheets

HUMIDIFICATION APPARATUS AND METHOD OF MANUFACTURE AND USE

RELATED APPLICATIONS

This application claims priority and is entitled to the filing date of U.S. Provisional application Ser. No. 60/753,700 filed Dec. 23, 2005, and entitled "Humidification Apparatus and Method." The contents of the aforementioned application are incorporated by to reference herein.

INCORPORATION BY REFERENCE

Applicants hereby incorporate herein by reference any and all U.S. patents and U.S. patent applications cited or referred to in this application.

BACKGROUND OF THE INVENTION

1. Field of the Invention

Aspects of this invention relate generally to humidification devices, and more particularly to disposable humidification devices.

2. Description of Related Art

The following art defines the present state of this field:

U.S. Pat. No. 1,474,254 to Gerstle is directed to an improved cigar-shaped humidor that is readily adaptable to various sizes of boxes within certain limits, and which will remain in proper position within the cigar box.

U.S. Pat. No. 1,481,325 to Gris is directed to improvements in devices for keeping cigars and tobacco moist in the form of a very simple article which may be placed in any form of a cigar box, humidor, tobacco box or other form of container and which will be adapted to retain itself in position therein notwithstanding variations in the sizes of the various containers. The device comprises in part a casing or shell formed of telescoping sections which are forced in opposite directions by a spring so that the sections will press against the sides or wall of the container and hold themselves in place. In the container there is an absorbent material for retaining the moisture and for giving off the moisture by evaporation.

U.S. Pat. No. 1,700,574 to Smith is directed to a humidor with means for keeping the water absorbing material in proper shape no matter how long used and with a means for shaking the excess of water from the absorbing material.

U.S. Pat. No. 2,623,781 to Hagan is directed to a disposable humidifier device for enclosure within the usual conventional cigarette pack, the device being placed within the pack by the manufacturer at the factory and which, when the pack is opened by the smoker, may then be suitably moistened for the purpose intended. The device is capable of ready and easy placement in or removal from the open end of a pack of cigarettes and can be produced at such an extremely low cost that its disposal after use remains a matter of little or no importance.

U.S. Pat. No. 3,323,784 to Fazio is directed to a humidifier including means for vaporizing water and a reservoir for containing the water which is to be vaporized that is constructed of inexpensive materials and that is of the disposable type in order that it may be thrown away and inexpensively replaced should it become excessively coated with scale in the form of an accumulation of minerals in the water being handled thereby.

U.S. Pat. No. 5,037,459 to Spruill et al. is directed to an insert for inclusion in a substantially sealed container to control the relative humidity within the container is provided. The insert is a packet at least part of the surface of which is a membrane capable of passing water vapor and which contains a buffering substance which is a saturated salt solution selected according to the desired relative humidity, and modified by a nonelectrolyte, if necessary, to adjust the relative humidity.

U.S. Pat. No. 5,230,867 to Kunze et al. is directed to a cartridge for an air freshener having a pad sealed within a housing by an air-permeable membrane. The density, permeability, and fiber characteristics of the pad and membrane are selected to achieve extended life while maintaining satisfactory air freshening performance.

U.S. Patent Nos. D394,522, D406,388, D408,099, and D409,330 to Putnam are directed to the ornamental designs for a humidor, as shown and described.

U.S. Pat. No. 5,829,452 to Oster is directed to a container, which may or may not be in the form of a cylinder conforming generally to the shape of a cigar, having a wall thickness and constitution which permits water vapor to escape therethrough, but which will not permit water droplets or palpable moisture to pass therethrough and subsequently over-wet the material to be humidified, such as cigars. The container is adapted to house a quantity of highly absorbent material, such as acrylamide potassium or sodium acrylate copolymer, cross-linked. End caps may be used as desired, including end caps with apertures therein to permit an accelerated rate of humidification by allowing more water vapor to escape the interior of the container than is allowed by ordinary osmosis through the walls of the container.

U.S. Pat. No. 5,934,773 to Ferrell is directed to a humidifier device including at least two housings, each housing containing an absorbent material. Each housing is designed as a stamped or molded cup-shaped member having rounded corners and a flanged edge, and a plurality of apertures. A flat, rectangular member is attached to the flanged edge, thereby creating a cavity between the flat, rectangular member and the cup-shaped member. The absorbent material is located within the cavity and is soaked with an evaporative solution for imparting moisture into the storage case by evaporation through the apertures in the housing. The humidifier device may be replenished by pouring solution through the apertures on the housings, or by immersing humidifier device in a bath of solution, thereby allowing the absorbent material to become replenished with solution. The housings are each provided with a magnet attached to the flat, rectangular member which can be used to mount the housing to a second magnet mounted on the interior of the storage case. In the preferred embodiment the housings are detachably joined by a frangible member. The frangible member allows the user to use the two housings as a single unit or as two separate units, depending on the humidity needs of any particular storage case. The humidifier device may include two, three, four, or more housings detachably joined to each other by frangible members.

U.S. Pat. No. 6,279,581 to Knepper is directed to a portable, flexible humidor for cigars. A flexible cigar storage compartment and a flexible moisture control compartment are connected by a passageway having a staggered series of channels which permit moisture-laden air to flow from one compartment to another while deterring the flow of liquid. Cigars are stored in the flexible cigar storage compartment and a moist sponge is inserted in the flexible moisture control compartment. Both compartments have resealable openings which permit the user to repetitively open and close the compartments to gain access to the cigars and the sponge.

International PCT Patent Application Publication No. WO 2002/051267 to Wirth is directed to a cigar humidifier (1) that is briefly immersed in water and then laid in the cigar box in place of a cigar. Water vapor steadily escapes through the body (9) that stores the water, through the water-permeable shell (10) and into the cigar box, through the openings (5, 6). In this way, the cigars are kept practically as fresh in their box as in an air-conditioned room, over a very long period. When a colored, self-adhesive strip (11) that is stuck to the water-permeable shell (10) becomes visible through the openings (6), this indicates that the cigar humidifier (1) needs to be re-immersed in water for further use.

U.S. Patent Application Publication No. US2003/0067086 to Mulvaney et al. is directed to a disposable tray liner for a humidifier reservoir including a bottom wall adapted for contacting a support surface of the reservoir and a continuous side wall that extends upwardly from the bottom wall. The bottom wall and continuous side wall form a water receiving receptacle that is adapted to cover the reservoir surfaces. When stale or stagnant water and mineral deposits form in the disposable tray liner, the disposable tray liner is removed from the humidifier and replaced with a new or fresh disposable tray liner. The removed disposable tray liner can be discarded or recycled.

The prior art described above teaches various humidors, a moistener for cigars and tobacco, a disposable humidifier for cigarette packs, a humidifier with throw-away reservoir, a device for controlling relative humidity within a substantially sealed container, an extended release fragrance dispensing cartridge, a humidification device, a humidifier device, a portable cigar humidor, a cigar humidifier, and a disposable tray liner for humidifiers, but does not teach a disposable humidification apparatus having an activation layer over a microporous membrane that alone is capable of regulating humidity without any additives to the water that is contained within the reservoir beneath the membrane, whether sponges or chemicals, as well as the associated methods of manufacturing and using such new and useful humidification apparatus. Aspects of the present invention fulfill these needs and provide further related advantages as described in the following summary.

SUMMARY OF THE INVENTION

Aspects of the present invention teach certain benefits in construction and use which give rise to the exemplary advantages described below.

In one aspect of the present invention, a humidification apparatus comprises a reservoir having at least one side wall defining an opening, water within the reservoir bounded by the at least one side, and a membrane activation assembly installed over the opening.

In a further aspect of the invention, the membrane activation assembly comprises a microporous membrane layer covering the opening of the reservoir and a temporary peel-away activation layer covering the membrane layer.

In still a further aspect of the invention, a method of providing humidification consists essentially of the steps of grasping a pull-tab formed on an activation layer of a membrane activation assembly installed on a reservoir, peeling the activation layer away from an underlying membrane layer of the membrane activation assembly, and inserting within an enclosed space the reservoir containing water bounded at its opening by the activated membrane layer, whereby the rate of vaporization of the water through the membrane layer controls the humidification of the enclosed space.

In yet a further aspect of the invention, a method of manufacturing a humidification apparatus comprises the steps of laminating an adhesive layer to a release liner, the adhesive layer having on its opposite side an adhesive carrier, die-cutting through the release liner and the adhesive layer to kiss-cut the adhesive carrier and form removable slugs, pulling the adhesive carrier away from the adhesive layer to remove the slugs from the release liner and the adhesive layer, laminating a microporous membrane to the adhesive layer, the microporous membrane having on its opposite side a membrane carrier, pulling the membrane carrier away from the microporous membrane, laminating a tab material to the microporous membrane, laminating an adhesive tape to the tab material and the microporous membrane, laminating a plastic carrier to the adhesive tape, and die-cutting through the release liner, the adhesive layer, the microporous membrane, the tab material, and the adhesive tape to kiss-cut the plastic carrier and so form a membrane activation assembly to be installed on a reservoir.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

Figure 1:
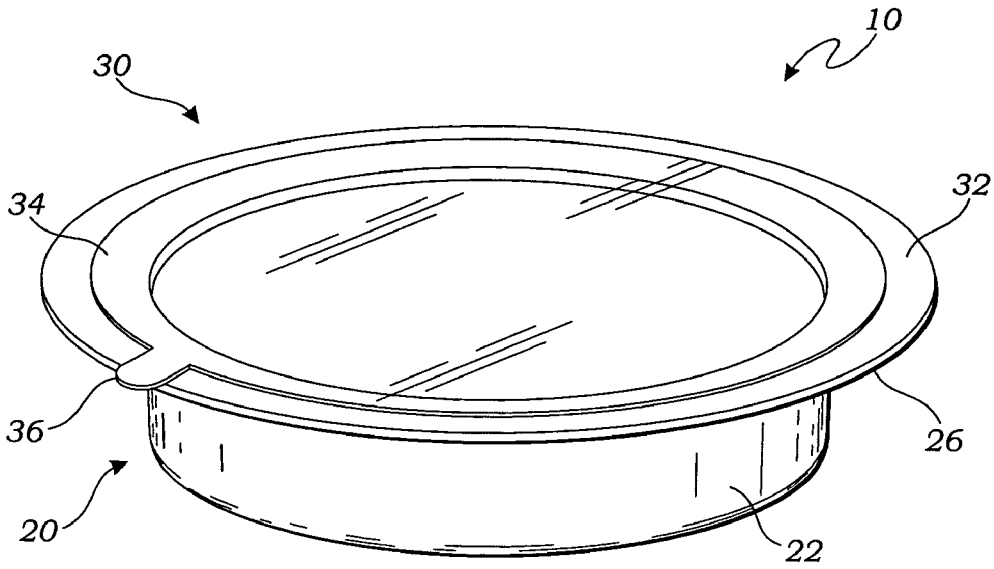
FIG. 1 is a perspective view of an exemplary embodiment of the invention.

The above described drawing figures illustrate aspects of the invention in at least one of its exemplary embodiments, which are further defined in detail in the following description.

The subject of this patent application is generally an improved humidification apparatus and method for making and using such.

In the art of humidifying such items as cigars so as to keep them moist and fresh, numerous devices have been introduced over the years. As is known in the art, cigars and other such tobacco products must be stored in a humid environment in order to maintain their freshness, usually on the order of seventy percent (70%) relative humidity. Typically, sealed containers known as humidors designed for this purpose include humidification systems that must be manually and routinely monitored and replenished. These systems essentially entail a reservoir to which a solution of water and a chemical such as propylene glycol must be added. Water alone will usually over-humidify the cigars, so a controlling agent like propylene glycol is often mixed with the water in the right proportion in order to maintain the relative humidity within the humidor ideally between sixty-eight and seventy percent (68-70%). The ratio of water and propylene glycol is therefore often critical to the performance of the humidifier, as the chemical acts to regulate the vaporization rate and, thus, the humidity level. The process of mixing such chemicals with water in the right proportion and constantly monitoring and replenishing the resulting solution as is required in most standard humidifiers is messy and inconvenient and is easy to get wrong or simply forget, resulting in spoiled or dried out cigars.

To address some of these shortcomings associated with conventional cigar humidors and humidification systems, attempts have been made to provide humidification devices that are either single-use, disposable units or that at least do not rely on the addition and monitoring of chemicals. For example, in U.S. Pat. No. 5,037,459 to Spruill et al. entitled "Device for Controlling Relative Humidity within a Substantially Sealed Container," there is disclosed "a packet at least part of the surface of which is a membrane capable of passing water vapor and which contains a buffering substance which is a saturated salt solution selected according to the desired relative humidity, and modified by a non-electrolyte, if necessary, to adjust relative humidity." Or, in U.S. Pat. No. 5,829,452 to Oster, there is disclosed a "Humidification Device" containing a super-absorbent material to which an aqueous solution of either water or a water-propylene glycol mix is added and which "does not drip or give off palpable moisture except through evaporation." It follows that such prior art humidification devices attempt to overcome the problems commonly associated with conventional humidor humidification systems by either employing an aqueous salt solution or what is effectively a sponge within the device, either of which then acting in cooperation with a water-vapor-permeable surface of the device in order to control the rate of vaporization and, thus, the relative humidity. Therefore, these prior art devices still have the shortcomings of either requiring some additive to the water itself to control the rate of vaporization or having to still monitor and replenish the water level, even if no chemicals are added.

The present invention is directed to a convenient, disposable humidification system for maintaining the appropriate humidity level in a cigar humidor or other such container without the addition of chemicals and without any monitoring or maintenance. Rather, in sum, the humidification apparatus of the present invention is configured with an activatable microporous membrane that alone regulates the vapor exchange rate without the addition of chemicals, salts, sponges or any other such further control agents. The humidification apparatus includes four basic components: (1) an outer casing or reservoir; (2) water within the reservoir; (3) a microporous membrane covering the opening of the reservoir; and (4) a temporary peel-away layer covering the membrane. Accordingly, when the peel-away layer is removed, the humidification system is immediately activated. In the exemplary embodiment, the properties of the microporous membrane, effectively, its vapor exchange rate, are selected so that the volume of water within the reservoir can evaporate through the membrane at such a rate to keep approximately twenty-five (25) cigars fresh for about thirty (30) days. Then, once a month on average the user will remove and discard the used humidification apparatus and simply activate and insert another disposable humidifier into the humidor for a further thirty (30) days of humidification. Again, no chemicals are involved, much less any that must be mixed with the water at the proper ratio and then routinely monitored by the user. The microporous membrane effectively serves as the vaporization regulator, having benefits in terms of safety and convenience as well as cost-savings. While particular exemplary embodiments of the present invention are shown and described in terms of its shape and size and the resulting typical usage, it will be appreciated by those skilled in the art that a virtually infinite number of configurations of the humidification apparatus may be employed depending on the particular context without departing from the spirit and scope of the invention.

Figure 2:
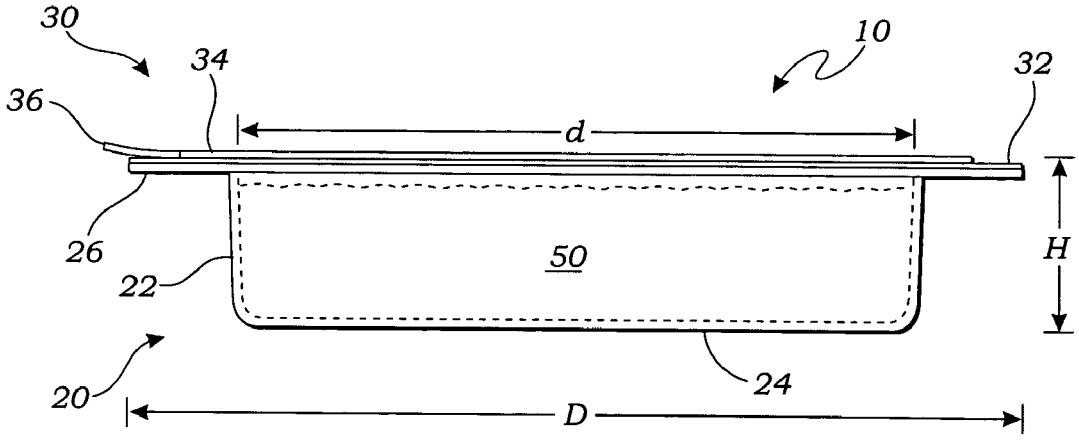
FIG. 2 is a side view thereof.

Turning now to FIG. 1, there is shown a perspective view of a first exemplary embodiment of the humidification apparatus 10 of the present invention comprising a reservoir 20 having a membrane activation assembly 30 installed over its opening. The reservoir 20 is generally annular or cup-shaped and, in the exemplary embodiment, has an overall diameter D of approximately two inches (2") and a depth H of approximately one-half inch (½") so as to fit within the typical humidification system round receptacle of humidors designed for up to fifty (50) cigars. Again, it will be appreciated that numerous other sizes and configurations of the humidification apparatus may be employed, such as a rectangular version similarly configured to be housed within the typical humidification system receptacles of larger humidors designed to house up to one hundred (100) or more cigars. As best seen in FIG. 2, a side view of the humidification apparatus 10 of FIG. 1, the reservoir 20 is configured as a relatively thin-wall cup having an annular side wall 22 and a substantially flat bottom 24 and shaped and formed of any suitable plastic so as to contain the water 50. Such plastic may be polypropylene, polyethylene, nylon, acrylonitrile butadiene styrene or any other material that is effectively nonporous and generally able to retain its shape. The plastic may be translucent or opaque and of any color. The opening of the reservoir 20 substantially opposite the bottom 24 is formed with a radially-outwardly-projecting flange 26 so as to provide a surface on which the membrane activation assembly 30 is installed. In the exemplary embodiment, the side wall 22 of the reservoir 20 defines an inside surface having an inside diameter d of approximately one-and-one-half inch (1½"), such that the radial width of the flange is approximately one-quarter inch (¼") all the way around. It will be appreciated by those skilled in the art, then, that the area defined by the opening of the reservoir 20, and over which the membrane activation assembly 30 extends and operates, is approximately two square inches (2 $in^2$), more about which will be said below in connection with FIG. 4 and the operation of the device 10 in use. With continued reference to FIG. 2, the membrane activation assembly 30 is comprised essentially of a membrane layer 32 and an activation layer 34. The membrane layer 32 is installed directly onto the flange 26 as by a pressure sensitive adhesive. The activation layer 34 is then installed over the membrane layer 32 also by means of a sealable, releasable adhesive. It will be appreciated by those skilled in the art that other means of installing the layers 32, 34 to each other and the membrane layer 32 to the cup 20 now known or later developed, including but not limited to thermal or chemical bonding or sonic/RF or ultrasonic welding, may be employed without departing from the spirit and scope of the invention. The outside diameter of both the membrane layer 32 and the activation layer 34 is between the overall diameter D of the apparatus, or the perimeter of the flange 26, and the inside diameter d of the side wall 22 of the reservoir cup 20. In this way, it will be appreciated that both layers 32, 34 span the opening of the reservoir 20 so as to cooperate in retaining the water 50 in liquid form within the reservoir. Accordingly, it is preferable that the diameter of the membrane layer 32 is substantially equivalent to the overall diameter D of the apparatus 20 so as to insure that the opening is completely covered and that a good surface-to-surface adhesive bond is formed between the membrane layer 32 and the upper surface of the flange 26. Similarly, the perimeter of the adjacent activation layer 34 also preferably extends radially beyond the inside diameter d of the reservoir 20 so as to insure that no vapor transmission begins through the membrane layer 32 until the activation layer is peeled away to activate the humidification apparatus 10, as explained more fully below. The activation layer 34 is formed with a pull-tab 36 to facilitate removal of the activation layer. Preferably, the tab 36 extends radially beyond and/or up and away from the flange 26 for easy access when activating the humidifier 10. With regard to the construction of the humidification apparatus 10, it will be appreciated by those skilled in the art that in order for the membrane layer 32 to selectively allow the transmission of water vapor therethrough while not allowing the passage of water in liquid form, the membrane must be microporous. It has been determined that an acceptable range for the moisture vapor transmission rate ("MVTR") of the membrane layer 32 is two hundred to three thousand (200-3,000) g/m$^2$ per day. In the exemplary embodiment, the membrane layer 32 is an approximately quarter mil to ten mil (0.00025"-0.01") thick microporous material having an MVTR of approximately one thousand two hundred (1,200) g/m$^2$ per day. For the purpose of handling and manufacturing, the film 32 may be cast onto a one to five mil (0.001"-0.005") silicone-coated polyester. The activation layer 34, on the other hand, is configured to prevent vapor transmission and so is preferably formed of a suitable nonporous plastic film. The water 50 placed within the reservoir 20 prior to the installation of the membrane activation assembly 30 is preferably purified water, without any further additives of any kind, though other additives for purposes other than controlling or affecting vapor exchange rate, such as an anti-microbial additive, may be added to the purified water during manufacturing without departing from the spirit and scope of the invention. In the exemplary embodiment of FIGS. 1-4, the volume of water initially placed within the reservoir 20 is approximately ten cubic centimeters (10 cc) so as to humidify approximately twenty-five (25) cigars for thirty (30) days in cooperation with the regulated vapor transmission through the membrane layer 32.

Figure 3:
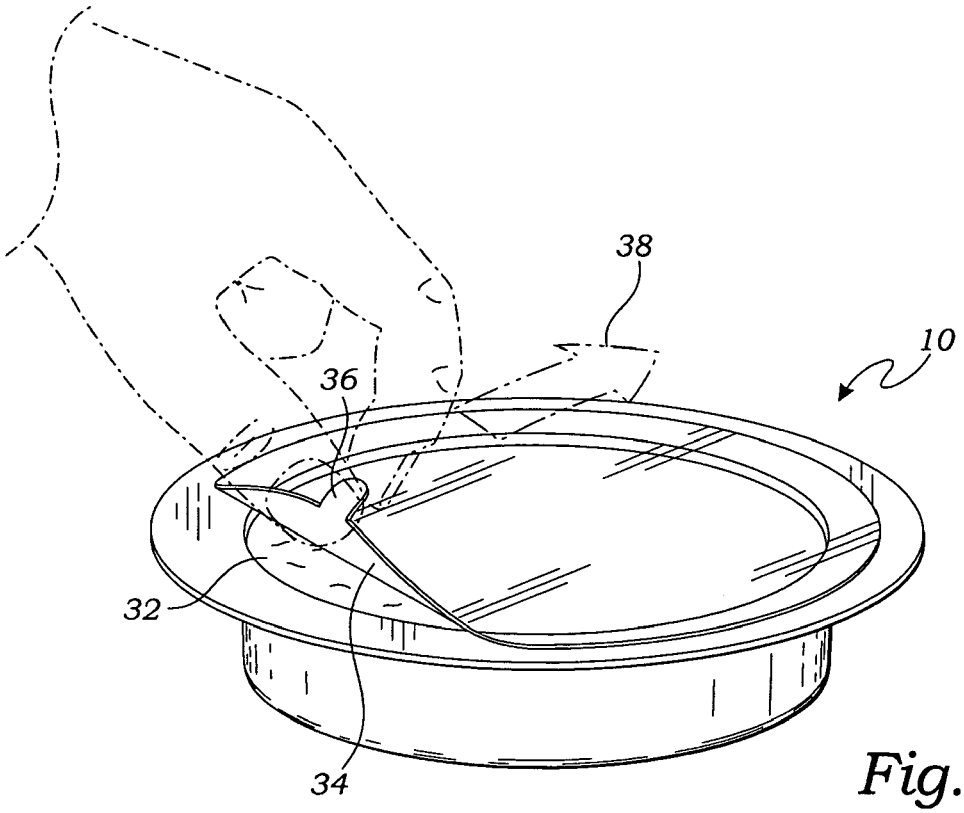
FIG. 3 is a perspective view thereof being prepared for use.
Figure 4:
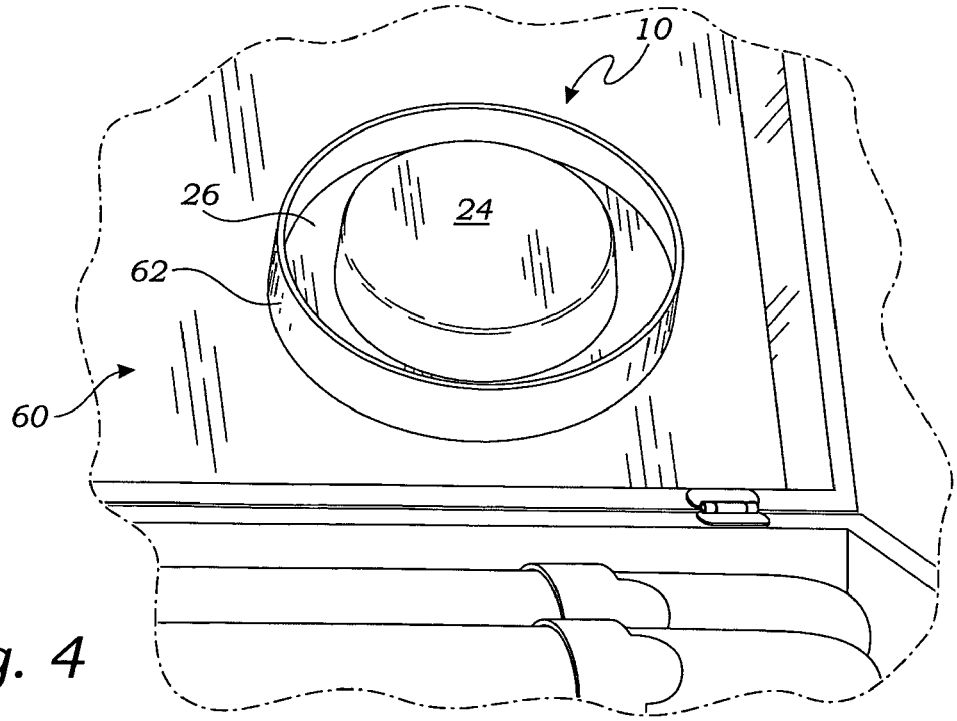
FIG. 4 is a perspective view thereof placed within a cigar box.

Turning to FIG. 3, in order to activate the humidification device 10 for use, the activation layer 34 is simply peeled away in the direction of arrow 38 by grasping the pull-tab 36 so as to expose more and more of the membrane layer 32. Eventually, the activation layer 34 is completely removed and the activated humidification apparatus 10 is placed within the humidification system receptacle 62 of the typical cigar humidor 60 as is shown in FIG. 4. The receptacle 62 is configured with a cap (not shown) to close the opening and retain the humidifier within. The receptacle is then also configured with holes (not shown) to allow water vapor from the humidifier to pass out of the receptacle and into the larger interior space of the humidor 60. It will be appreciated that this interior space will be substantially sealed when the lid is closed and that in such position, the humidification apparatus 10 will be substantially upright with the bottom 24 facing down, effectively sitting on the cap (not shown) of the receptacle 62. It will be further appreciated, though, that the humidifier of the present invention will still operate effectively regardless of its spatial orientation, so long as the membrane layer is exposed. With the membrane layer 32 thus completely exposed and providing the only barrier between the water 50 (FIG. 2) that is pre-filled in the humidification apparatus 10 and the ambient conditions of the humidor 60, the evaporation of the water and the ensuing vapor exchange through the membrane layer immediately begins. Based on the volume of water originally supplied within the device 10 of approximately 10 cc and the MVTR and surface area of approximately 2 in$^2$ of the membrane layer 32, the vaporization continues over a period of time, typically about thirty (30) days, so as to control the relative humidity within the humidor 60 at around seventy percent (70%). It will be appreciated by those skilled in the art that these rates are approximate and merely exemplary and will be affected by numerous other factors, such as the size of the container to be humidified and the number and initial moisture level of the cigars within the container. Relatedly, it will be further appreciated that not only does the disposable humidification apparatus 10 of the present invention allow for convenient and fool-proof humidification, but because it is a self-contained system including the water and reservoir, virtually any container can be quickly and easily transformed into a humidor; e.g., cigar boxes, jars, Tupperware® containers, ZipLoc® bags, etc. The user would simply insert the cigars and an activated humidifier 10 as described above and close the lid or otherwise seal the container. For such uses, the humidifiers 10 may further include an adhesive on the bottom 24 of the cup 20, i.e., on the side opposite the membrane 32, so as to conveniently attach the humidifier to the lid or other surface of the larger container serving as the humidor. Once a humidification apparatus 10 has been so activated and all or substantially all of the water has evaporated out so as to humidify the container within which the apparatus was placed along with its contents, the used apparatus is simply removed and discarded and a new one is activated and installed as described above.

Figure 5:
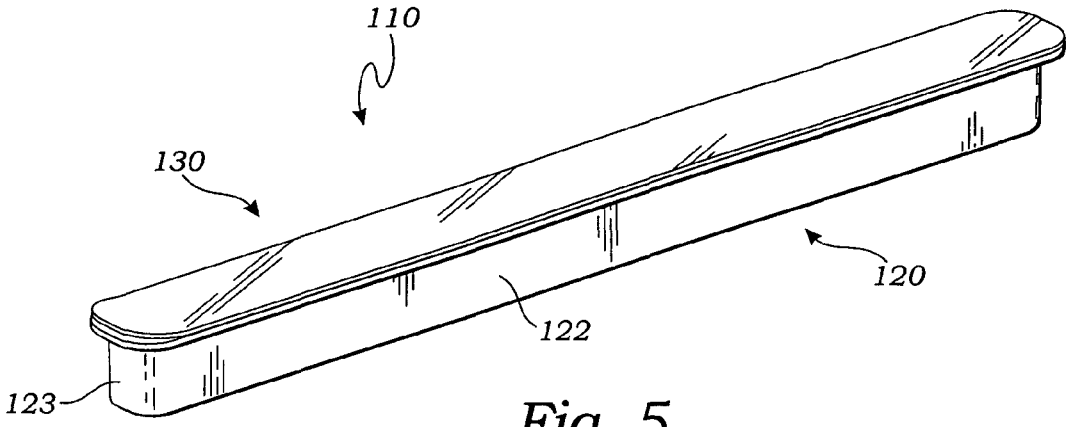
FIG. 5 is a perspective view of an alternative exemplary embodiment of the invention.
Figure 6:
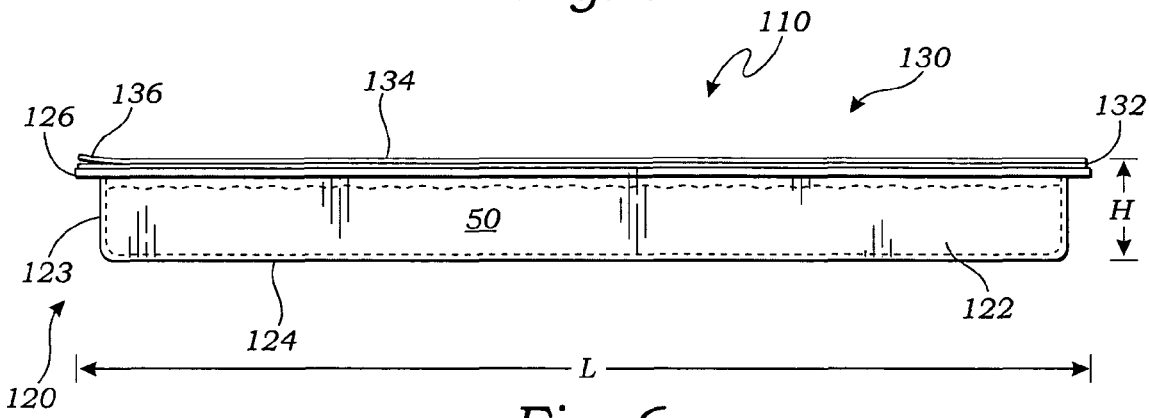
FIG. 6 is a side view thereof.
Figure 7:
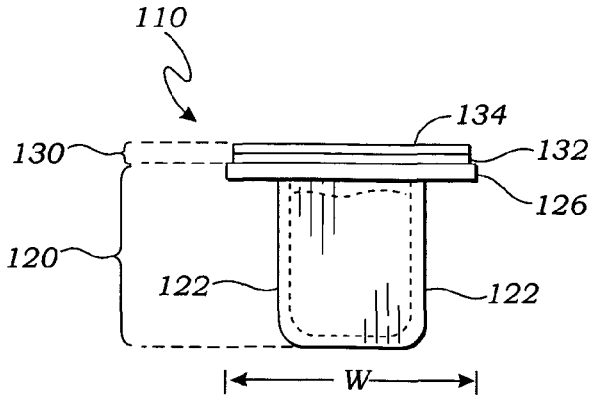
FIG. 7 is an end view thereof.

Referring now to FIGS. 5-7, there is shown an alternative exemplary embodiment of the humidification apparatus 110 of the present invention that is substantially elongated in shape, much like a cigar or cigarette. There is again a reservoir 120 and a membrane activation assembly 130 installed over its opening. In the alternative, though, the reservoir has a substantially rectangular profile and, in the exemplary embodiment, has an overall length L of approximately five inches (5"), a width W of approximately one-half inch (½"), and a depth H of approximately one-half inch (½") so as to somewhat simulate in size and shape the average cigar and so be configured to lay in a cigar box or other such container right alongside the other cigars, as explained more fully below. Again, it will be appreciated that numerous other sizes and configurations of the humidification apparatus may be employed without departing from the spirit and scope of the invention. As best seen in FIG. 6, a side view of the humidification apparatus 110 of FIG. 5, the reservoir 120 is configured as a relatively thin-wall housing having substantially vertical side and end walls 122, 123 and a substantially flat bottom 124 and formed of any suitable plastic so as to contain the water 50. The opening of the reservoir 120 substantially opposite the bottom 124 is formed with a radially-outwardly-projecting flange 126 so as to provide a surface on which the membrane activation assembly 130 is installed. In the exemplary embodiment, the side and end walls 122, 123 of the reservoir 120 define an inside surface having inside dimensions of approximately one-quarter inch (¼") by four-and-three-quarter inch (4¾"), such that the radial width of the flange is approximately one-eighth inch (⅛") all the way around. It will be appreciated by those skilled in the art, then, that the area defined by the opening of the reservoir 120, and over which the membrane activation assembly 130 will extend and operate, is approximately one square inch (1 in$^2$). With continued reference to FIG. 6, the membrane activation assembly 130 is comprised essentially of a membrane layer 132 and an activation layer 134. The membrane layer 132 is installed directly onto the flange 126 as by a pressure sensitive adhesive. The activation layer 134 is then installed over the membrane layer 132 also by means of a sealable, releasable adhesive. It will again be appreciated by those skilled in the art that other means of installing the layers 132, 134 to each other and the membrane layer 132 to the reservoir 120 now known or later developed, including but not limited to thermal or chemical bonding or sonic/RF or ultrasonic welding, may be employed without departing from the spirit and scope of the invention. The outside dimensions of both the membrane layer 132 and the activation layer 134 are at least greater than the inside dimensions of the opening formed by the inside surfaces of the side and end walls 122, 123 of the reservoir 120 of one-quarter inch by four and three-quarter inches (¼"×4¾"), preferably approaching or even extending beyond the overall outside dimensions of the apparatus 110, or the perimeter of the flange 126, of approximately one-half inch by five inches (½"×5"). In this way, it will be appreciated that both layers 132, 134 span the opening of the reservoir 120 so as to cooperate in retaining the water 50 in liquid form within the reservoir. Accordingly, it is preferable that the dimensions of the membrane layer 132 are substantially equivalent to the overall dimensions of the apparatus 120 so as to insure that the opening is completely covered and that a good surface-to-surface adhesive bond is formed between the membrane layer and the upper surface of the flange 126. Similarly, the perimeter of the adjacent activation layer 134 also preferably extends sufficiently beyond the inside dimensions of the reservoir 120 so as to insure that no vapor transmission begins through the membrane layer 132 until the activation layer is removed. The activation layer 134 is again formed with a pull-tab 136 to facilitate removal of the activation layer. The tab 136 may again extend beyond or up and away from the flange 126 for easy access when activating the humidifier 110. Furthermore, as in the exemplary embodiment shown in FIGS. 5-7, where the tab 136 is inset beyond the inner surface of the reservoir 120 such that the membrane layer 132 would not be directly covered by the activation layer 134 and so be exposed to begin the vaporization process prematurely, it will be appreciated by those skilled in the art that the exposed portion of the membrane layer 132, or the end of the membrane layer adjacent to the pull-tab 136, may be formed with a permanently-adhered, nonporous skin or coating so as to cooperate with the removable activation layer 134 in preventing or reducing vapor transmission until the humidification apparatus 110 is activated by removal of the activation layer 134. For ease of manufacturing and assembly, a similar nonporous skin may also be formed at the end of the membrane 132 opposite the pull tab 136. With regard to the construction of the membrane and activation layers 132, 134 cooperating to selectively allow the transmission of water vapor therethrough while not allowing the passage of water in liquid form, the same disclosure as above in connection with the exemplary embodiment of FIGS. 1-4 would apply equally here to the alternative exemplary embodiment of FIGS. 5-7. The volume of water initially placed within the reservoir 120 is approximately five cubic centimeters (5 cc) so as to humidify approximately one dozen (12) cigars for thirty (30) days in cooperation with the regulated vapor transmission through the membrane layer 132. As above in connection with the exemplary embodiment of FIGS. 1-4, in order to activate the humidification device 110 for use, the activation layer 134 is simply peeled back by grasping the pull-tab 136 so as to expose more and more of the membrane layer 132 until the activation layer 134 is completely removed. The activated humidification apparatus 110 is then simply placed within the humidor, cigar box, jar or other such sealable container housing up to about a dozen cigars, typically by being laid right alongside the other cigars, though the humidifier can also function standing upright as well, as in a jar or other such container that is serving as the humidor. With the membrane layer 132 thus completely exposed and providing the only barrier between the water 50 (FIG. 6) that is pre-filled in the humidification apparatus 110 and the ambient conditions of the container, the evaporation of the water and the ensuing vapor exchange through the membrane layer immediately begins. Once more, based on the volume of water originally supplied within the device 110 of approximately 5 cc and the MVTR and surface area of approximately 1 $in^2$ of the membrane layer 132, the vaporization continues over a period of time, typically about thirty (30) days, so as to control the relative humidity within the container at around seventy percent (70%). It will again be appreciated by those skilled in the art that these rates are approximate and merely exemplary and will be affected by numerous other factors, such as the size of the container to be humidified and the number and initial moisture level of the cigars within the container. Of course, it will be further appreciated that multiple humidifiers may be used depending on the size of the container and the number of cigars to be humidified. For example, if a standard humidor housing up to about twenty-five (25) cigars were to be humidified using the alternative humidification device 110 shown in FIGS. 5-7, two such devices could simply be activated and placed in such a humidor simultaneously so as to provide roughly the same humidification over a thirty-day period as a single humidifier 10 according to the first embodiment of FIGS. 1-4. As before, in any such context, once the one or more humidification devices 110 have been so activated and all or substantially all of the water has evaporated out so as to humidify the container within which the devices were placed along with its contents, the used humidifiers are simply removed and discarded and one or more new ones activated and inserted as described above.

Based on the foregoing, it will be appreciated by those skilled in the art that the consistent performance of the exemplary microporous membrane is evidenced by the vaporization estimates for the humidification apparatus of the present invention, in that a comparison of the first and second exemplary embodiments indicates that reducing by half the volume of water and membrane surface area results in a corresponding reduction by about half of the number of cigars that can be humidified over the same time period. Or, put another way, it has been discovered in connection with the exemplary embodiments of the present invention employing a microporous membrane having an MVTR of roughly one thousand two hundred (1,200) $g/m^2$ per day that a ratio of approximately five cubic centimeters (5 cc) of water to every square inch (1 $in^2$) of exposed surface area of the membrane provides relative humidity on the order of seventy percent (70%) for approximately thirty (30) days. Thus, those skilled in the art will appreciate that depending on the size of the container and/or the number of cigars to be humidified, numerous other configurations and combinations of humidification devices built around these ratios can be employed without departing from the spirit and scope of the invention. Moreover, it will be appreciated that all of these ratios and vaporization durations are merely exemplary and are based on a single exemplary microporous membrane having a specific MVTR. Accordingly, numerous other humidification devices employing other such membranes at least having an MVTR range of two hundred to three thousand (200-3,000) $g/m^2$ per day, and thereby resulting in wholly distinct performance characteristics and, hence, functional volume-to-surface-area ratios for the exemplary thirty (30) days of humidification, are also possible in the present invention. Of course, the thirty-day vaporization duration of the exemplary device is also merely exemplary and is one more variable that can be modified depending on the application without departing from the spirit and scope of the invention. For example, assuming the same exemplary microporous membrane having an MVTR of roughly one thousand two hundred (1,200) $g/m^2$ per day is employed, a ratio of approximately ten cubic centimeters (10 cc) of water to every square inch (1 $in^2$) of exposed surface area of the membrane would provide relative humidity on the order of seventy percent (70%) for approximately sixty (60) days.

Figure 9:
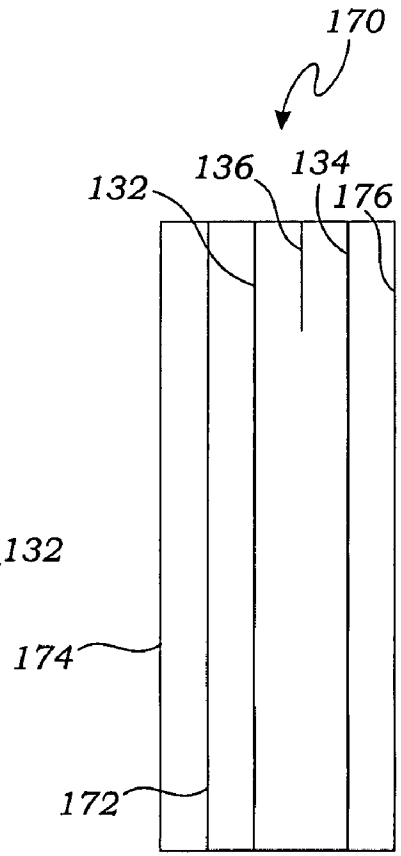
FIG. 9 is a schematic side view of the intermediate manufacturing step thereof.
Figure 8:
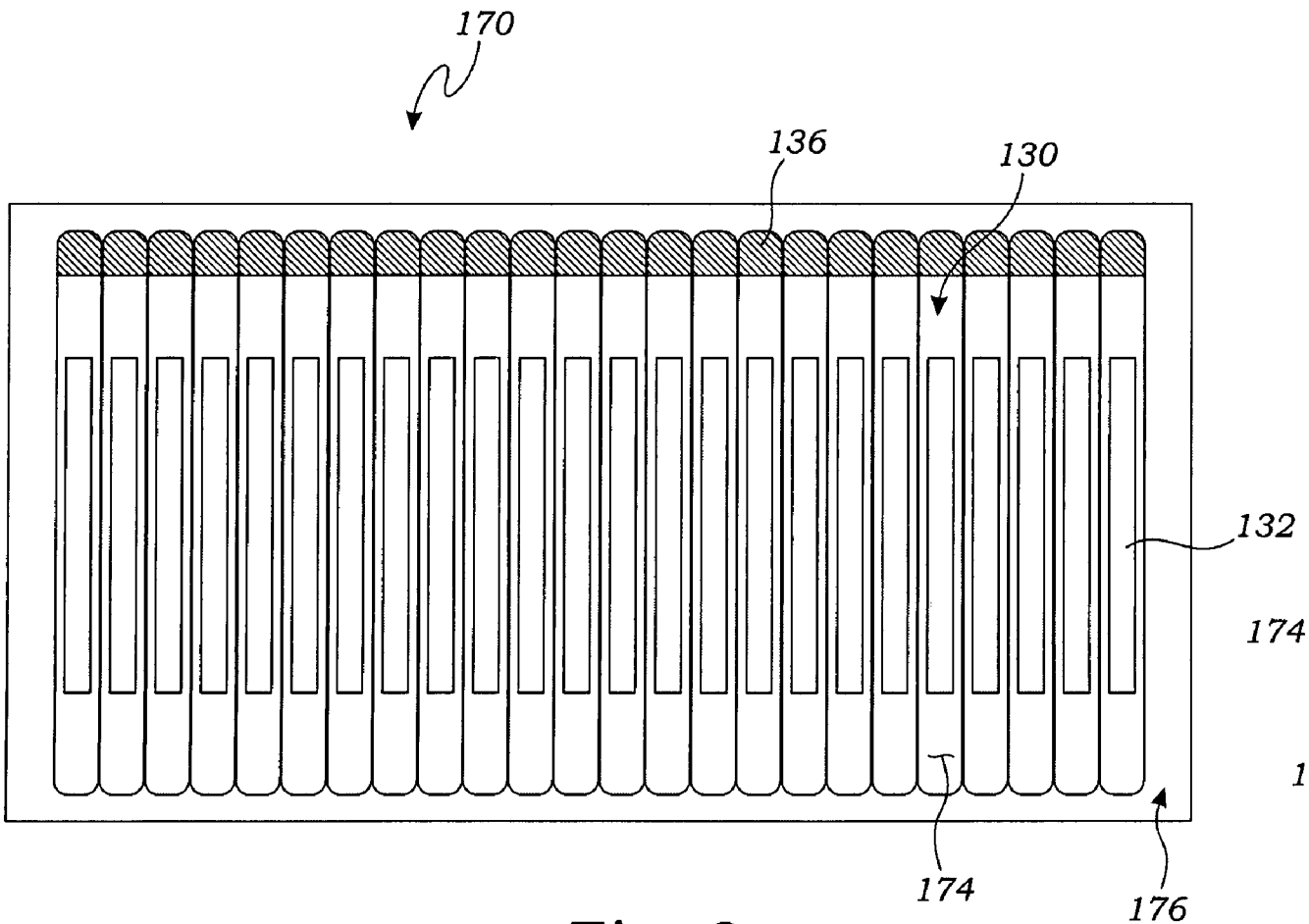
FIG. 8 is a top view of an intermediate manufacturing step thereof.
Figure 10:
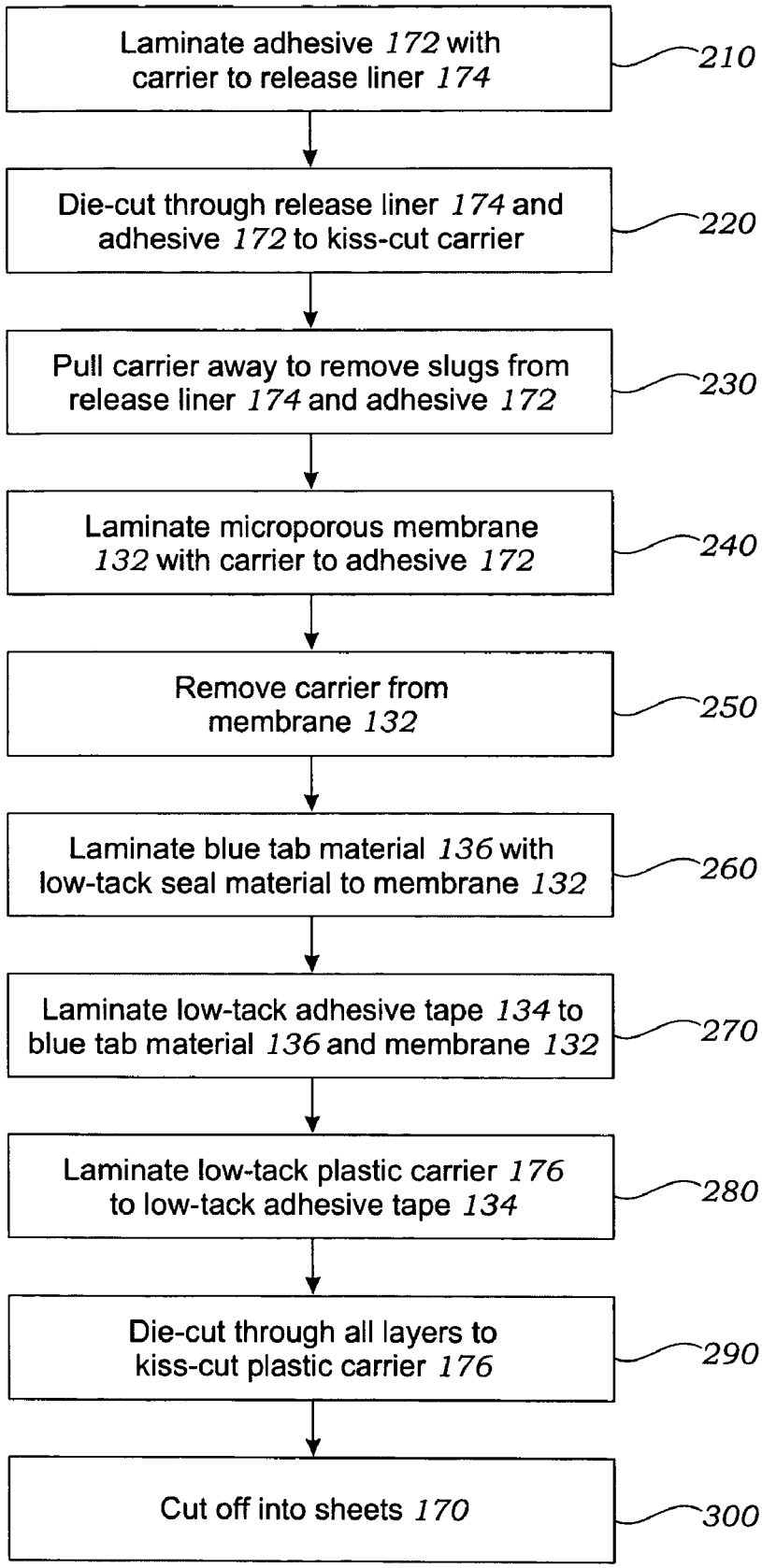
FIG. 10 is a flow chart of an exemplary manufacturing process thereof.

Turning to FIGS. 8 and 9, in terms of the method of manufacturing the humidification devices of the present invention, in connection with the second exemplary embodiment of FIGS. 5-7, there is depicted in more detail a top view and side schematic view of the membrane activation assembly 130 as formed in a continuous or semi-continuous process with several such assemblies 130 removably attached to one another as formed on a layered sheet 170 in an intermediate configuration. The layers and the manner in which they are assembled will be best understood with further reference to FIG. 10, which depicts in flow chart format the process by which are formed the layered sheets 170, themselves forming multiple membrane activation assemblies 130 each. Generally, the layers of each sheet 170 are shown and described in the exemplary process as being assembled through pressure-sensitive adhesives, such adhesives, in fact, defining certain layers within the assembly, whereby the assemblies are formed through continuous roller equipment properly equipped with dies, knives, turning rollers, and other such devices as explained more fully below in the context of the steps shown in FIG. 10. For now, it will again be appreciated that while the exemplary manufacturing process relates to a pressure-sensitive adhesive assembly means, that other means now known or later developed in the art, whether continuous, semi-continuous, single-stage, multi-stage, automated, semi-automated or manual, or any combination thereof, may be employed in manufacturing humidification devices according to the present invention. Turning again to FIG. 10, then, there is shown a first step 210 in the manufacturing process in which an adhesive 172 that is supplied on a temporary supply carrier (not shown) is laminated to a release liner 174. In the exemplary embodiment, the adhesive 172 is a pressure-sensitive adhesive and the release liner is silicone-coated. At step 220, a die (not shown) is employed having a profile configured to form the rectangular window through the adhesive 172 through which the microporous membrane 132 will eventually be in substantially fluid communication with the water within the humidifier. While the die could, thus, have a profile that is substantially equivalent to the inside dimensions of the reservoir 120 as defined by the inside surfaces of the side and end walls 122, 123 (FIGS. 5-7) so that the resulting adhesive frame is substantially equivalent in size and shape to the upper surface of the reservoir flange 126, in the exemplary embodiment, in order to further reduce the potentially exposed surface area of the membrane 132 so as to account for the pull tab 136, the rectangular profile of the die, and the resulting cut-out in the adhesive 172, is configured to be smaller in at least length than the opening of the reservoir 120. With the die so configured, a die-cut is made through the release liner 174 and the adhesive 172 to kiss-cut the carrier (not shown) on which the adhesive 172 was originally supplied. In this way, at step 230, when the carrier is then pulled away from the adhesive 172, the cut-out rectangular slugs of adhesive and the added release liner 174 are then pulled out as well, leaving the above-described cut-out rectangular opening in the remaining adhesive-release liner laminate. Next, at step 240, the microporous membrane 132 also supplied on a temporary supply carrier (not shown) is laminated along its side opposite the carrier to the exposed side of the adhesive 172 opposite the release liner 174. This could be accomplished by feeding the membrane 132 from the opposite side of the machine or by first turning the adhesive-release liner laminate over as by a turn roller set-up. At step 250, the temporary carrier (not shown) is removed from the side of the microporous membrane 132 opposite the now laminated adhesive 172. Then, at step 260, a blue-colored tab material 136 with low-tack seal material is laminated to the exposed side of the membrane 132. In the exemplary embodiment such tab material 136 is a blue low-tack polyethylene. It will be appreciated that the blue color of the tab material 136 is merely exemplary and that any color, including natural or translucent, may be used, though having some opaque color distinct from the color of the membrane 132 and reservoir 120 is preferable so that the tab 136 is simply easier to locate during use. At step 270, a low-tack adhesive tape 134, which in use serves as the activation layer, is laminated to both the blue tab material 136 and the membrane 132. In the exemplary embodiment, the activation layer 134 is formed of a clear low-tack polyethylene material. Next, at step 280, a low-tack plastic carrier 176 is laminated to the low-tack adhesive tape 134. In the exemplary embodiment, the plastic carrier is a low-tack polyester material. Then, in connection with step 290, a second die (not shown) is formed having a profile substantially corresponding to the desired profile and perimeter dimensions of the membrane activation assembly 130, as described in detail above in connection with FIGS. 5-7. The outer perimeter die-cut is then made so as to form each of the assemblies 130 along the sheet 170, once more, whether staged or continuous or any other such process. This time, the die-cut is made through all layers from the side of the laminated assembly 130 having the release liner 174 and going up to and kiss-cutting the plastic carrier 176 at the opposite side of the assembly. The membrane activation assemblies 130 may then be peeled off of the carrier 176 and separated one from the other for assembly to the reservoir 120 as explained below. In the exemplary embodiment, for the primary purpose of material handling, as indicated at step 300, the resulting intermediate laminate assemblies are formed as sheets 170 by being intermittently cut off in groups of twenty-four (24) on sheets having an overall length of approximately thirteen inches (13"), though it will be appreciated that these dimensions, quantities and configurations of the sheets 170 are merely exemplary and that the invention is not so limited. Further, again, while a particular pressure-sensitive adhesive manufacturing method is shown and described, it will be appreciated by those skilled in the art that other means now known or later developed in the art may be employed in manufacturing humidification devices according to the present invention, whether continuous, semi-continuous, single-stage, multi-stage, automated, semi-automated or manual, and whether in connection with pressure-sensitive adhesives or thermal or chemical bonding, sonic/RF or ultrasonic welding, or any other such assembly technique now known or later developed, or any combination thereof. Moreover, it will be appreciated that the materials shown and described are also merely exemplary and that numerous other materials now known or later developed may be employed depending on the particular application and assembly method without departing from the spirit and scope of the invention. Once the membrane activation assemblies 130 are so formed on sheets 170, the manufacture of the humidification apparatus 110 is completed by a further process, again, either continuous and on-line with the above-described process or as a secondary operation. In any case, the separately molded or formed reservoir 120 is first filled with the appropriate amount of water, in the exemplary embodiment, approximately 5 cc. A membrane activation assembly 130 is then removed from the sheet 170 by being peeled off of the carrier 176 and separated from any adjacent assemblies 130. The release liner 174 is next peeled away to expose the adhesive 172, which is then pressed directly onto the flange 126 of the reservoir 120. It will be appreciated that by sealably installing the membrane activation assembly 130 over the reservoir 120 by engaging the adhesive 172 with and about the flange 126 in this manner and with the assembly 130 so oriented, the membrane layer 132 will be directly over the opening of the reservoir while the adhesive tape or activation layer 134 will define the outermost layer for removal thereof when activating the humidifier 110 as explained above. It will be further appreciated that the final assembly steps of filling the reservoir with water and installing the membrane activation assembly thereon, again, may be accomplished by a number of processes now known or later developed without departing from the spirit and scope of the invention. For example, where the entire humidification apparatus 110 is to be formed in a continuous process, even the reservoir 120 could be extruded from a nonporous, flexible material and brought together with a membrane activation assembly as above-described so as to form a pouch of sorts that may then be automatically filled or injected with water at or about the time the side edges of the respective layers are being bonded or joined to complete the construction. Once more, those skilled in the art will appreciate that these are merely examples and that the invention is not so limited.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A humidification apparatus comprising:

a reservoir having at least one side wall defining an opening;

water within the reservoir bounded by the at least one side;

a membrane layer covering the opening, the membrane layer being formed of a microporous material having a moisture vapor transmission rate of between two hundred and three thousand grams per square meter per day; and a temporary peel-away activation layer covering the membrane layer.

2. The apparatus of claim 1 wherein:

the side wall is substantially annular and terminates distally in a substantially flat bottom and proximally at the opening in a radially-outwardly-projecting flange; and the membrane activation assembly is installed on the flange.

3. The apparatus of claim 2 wherein:

the flange defines a perimeter having an overall diameter of approximately two inches;

the side wall defines an interior surface having an inside diameter of approximately one and one-half inch, whereby the width of the flange is approximately one quarter inch and the surface area of the opening is approximately two square inches; and the membrane activation assembly defines an outside diameter that is substantially between the inside diameter and the overall diameter, whereby the membrane activation assembly spans the opening of the reservoir so as to cooperate in retaining the water in liquid form within the reservoir.

4. The apparatus of claim 3 wherein the volume of water initially placed within the reservoir is approximately ten cubic centimeters.

5. The apparatus of claim 1 wherein the microporous material has a thickness of between 0.00025 inch and 0.01 inch and further has a moisture vapor transmission rate of approximately one thousand two hundred grams per square meter per day.

6. The apparatus of claim 1 wherein the activation layer is formed of a nonporous plastic film.

7. The apparatus of claim 1 wherein the activation layer is formed with a pull-tab to facilitate removal of the activation layer from the membrane layer during use, the pull-tab extending radially-outwardly of the activation layer.

8. The apparatus of claim 7 wherein an end of the membrane layer adjacent to the pull-tab is formed with a permanently-adhered, nonporous skin so as to cooperate with the removable activation layer in discouraging vapor transmission through the membrane layer until the apparatus is activated by removal of the activation layer.

9. The apparatus of claim 1 wherein:

the at least one side wall comprises substantially vertical side walls and end walls terminating distally in a substantially flat bottom and proximally in a radially-outwardly-projecting flange; and the membrane activation assembly is installed on the flange.

10. The apparatus of claim 9 wherein:

the flange defines a perimeter having an overall length of approximately five inches and an overall width of approximately one-half inch;

the side and end walls of the reservoir define an inside surface having inside dimensions of approximately one-quarter inch by four-and-three-quarter inches, whereby the radial width of the flange is approximately one-eighth inch and the surface area of the opening is approximately one square inch; and the membrane activation assembly defines outside dimensions that are substantially between the inside dimensions of the reservoir and the overall length and width of the perimeter of the flange, whereby the membrane activation assembly spans the opening of the reservoir so as to cooperate in retaining the water in liquid form within the reservoir.

11. The apparatus of claim 10 wherein the volume of water initially placed within the reservoir is approximately five cubic centimeters.

12. A method of manufacturing a humidification apparatus, comprising the steps of:

laminating an adhesive layer to a release liner, the adhesive layer having on its opposite side an adhesive carrier;

die-cutting through the release liner and the adhesive layer to kiss-cut the adhesive carrier and form removable slugs;

pulling the adhesive carrier away from the adhesive layer to remove the slugs from the release liner and the adhesive layer, the resulting release liner with adhesive layer defining a temporary peel-away activation layer;

laminating a microporous membrane to the adhesive layer, the microporous membrane being formed of a microporous material having a moisture vapor transmission rate of between two hundred and three thousand grams per square meter per day and having on its opposite side a membrane carrier;

pulling the membrane carrier away from the microporous membrane;

laminating a tab material to the microporous membrane;

laminating an adhesive tape to the tab material and the microporous membrane;

laminating a plastic carrier to the adhesive tape;

die-cutting through the release liner, the adhesive layer, the microporous membrane, the tab material, and the adhesive tape to kiss-cut the plastic carrier and so form a membrane activation assembly;

forming a reservoir having a perimeter flange about an opening;

filling the reservoir with water through the opening;

removing the membrane activation assembly from the plastic carrier; and sealably installing the membrane activation assembly over the reservoir by engaging the adhesive layer with the flange.

13. A humidification apparatus comprising:

a reservoir having at least one side wall defining an opening;

water within the reservoir bounded by the at least one side;

a microporous membrane layer covering the opening of the reservoir;

a temporary peel-away activation layer covering the membrane layer and formed with a pull-tab to facilitate removal of the activation layer from the membrane during use, the pull-tab extending radially-outwardly of the activation layer; and an end of the membrane layer adjacent to the pull-tab formed with a permanently-adhered, nonporous skin so as to cooperate with the removable activation layer in discouraging vapor transmission through the membrane layer until the apparatus is activated by removal of the activation layer.

* * * * *